US012012774B2

(12) United States Patent
Davis et al.

(10) Patent No.: US 12,012,774 B2
(45) Date of Patent: Jun. 18, 2024

(54) SUB-SURFACE POST REMOVER

(71) Applicants: Randy Edward Davis, Spring, TX (US); Jeffrey Randall Davis, Spring, TX (US)

(72) Inventors: Randy Edward Davis, Spring, TX (US); Jeffrey Randall Davis, Spring, TX (US)

( * ) Notice: Subject to any disclaimer, the term of this patent is extended or adjusted under 35 U.S.C. 154(b) by 360 days.

(21) Appl. No.: 17/571,608

(22) Filed: Jan. 10, 2022

(65) Prior Publication Data

US 2023/0220700 A1 Jul. 13, 2023

(51) Int. Cl.
*B66F 3/00* (2006.01)
*E04H 17/26* (2006.01)

(52) U.S. Cl.
CPC ..... *E04H 17/265* (2013.01)

(58) Field of Classification Search
CPC ..... E04H 17/265; E04H 17/263
See application file for complete search history.

(56) References Cited

U.S. PATENT DOCUMENTS 4,256,286 A * 3/1981 Hudgins ..... E04H 17/265 254/30
4,804,165 A 2/1989 Pippin et al.
5,704,591 A 1/1998 Byrne
5,934,649 A * 8/1999 Drane ..... E04H 17/265 254/131
6,398,188 B1 6/2002 Salman
6,527,250 B1 3/2003 Tyson
6,598,856 B1 * 7/2003 Puff ..... E04H 17/265 254/30
6,866,248 B1 3/2005 Sears
7,431,266 B1 10/2008 Evans
7,996,972 B2 * 8/2011 Hu ..... B25B 27/026 29/259
8,444,114 B2 5/2013 Rivard
10,132,102 B2 11/2018 Barbara et al.
2020/0370328 A1 11/2020 Cervantes
2022/0268055 A1 * 8/2022 Peabody ..... E04H 17/265
2023/0220700 A1 * 7/2023 Davis ..... E04H 17/265 254/30

FOREIGN PATENT DOCUMENTS

GB 2298843 10/1998
GB 2425296 10/2006
GB 2511420 9/2014

* cited by examiner

*Primary Examiner* — Lee D Wilson
(74) *Attorney, Agent, or Firm* — The Petruzzi Law Firm; James D. Petruzzi

(57) ABSTRACT

A sub-surface pole and pole foundation remover having a portable frame, a cylinder mounted on the frame and configured to receive pressurized fluid, a lifting piston slidably mounted in the cylinder, a grapnel connected to the lifting piston and having a plurality of lower arms that extend from a bottom circular support and that are configured to grip a sub-surface pole located below ground, and a control lever configured to direct the pressurized fluid to the cylinder that is actuated to cause the lifting piston to extend and push the grapnel upward relative to the portable frame to remove the pole from the ground. The grapnel may have a top circular support and a middle circular support connected to the top circular support by a plurality of flexible cables. A cinching cable may be used to grip the pole, the grapnel may have gripping teeth and fluid may be hydraulic.

12 Claims, 5 Drawing Sheets

SUB-SURFACE POST REMOVER

TECHNICAL FIELD

The present invention relates to pole removers. More specifically the present invention relates to a portable sub-surface pole remover for removing fence posts, sign posts and the like. Preferably, the pole remover can be operated by an individual person. The terms "pole" and "post" include poles or like elongate members, with or without a foundation, such as a foundation formed of concrete, and the term "post" is used hereinafter for convenience only and is not intended to be limiting on the scope of the invention.

BACKGROUND

Pulling fence posts or poles out of the ground is more difficult than most people realize. Fence posts are often used to support, e.g., backyard fences. When such fences are installed, the bottoms of the fence posts are typically encased in concrete so that the posts do not fall over and can support rails or fence segments that extend between the posts. Some posts may be placed in ground that may harden over time. When a concrete foundation is poured and hardened, the foundation may end up being relatively large and heavy. Foundations weighing upwards of 200 lbs. are difficult to remove. Several people may have to dig a large hole over several days just to remove a single post and its associated concrete foundation.

To address these issues, Great Britain Patent Document No. GB2511420, incorporated herein by reference, discloses an apparatus for raising a post. The apparatus includes a support frame that has a transverse base portion of rectangular shape. An arm is provided with a guide post which connects with the post. A ram has a fluid operated piston/cylinder device having a piston slidably mounted in a cylinder. The cylinder is connectable to a fluid source for actuating and extending the piston to raise the arm thus raising the post. However, this arrangement of GB2511420 does not connect to the post in a secure manner and has no provision for lifting buried posts.

In addition, U.S. Pat. No. 6,598,856 discloses a portable hydraulic stake puller 1. During operation, a lifting tube 25 is raised by a hydraulic cylinder 21 pressing against the resiliency of spring members 43, 43 operably retained in spring tubes 45, 45. During downward operation, spring members 43, 43 return lifting tube 25 to its starting position. This operation occurs when a control lever 7 is released, allowing a valve 17 to return from an open position to a neutral position. The arrangement of U.S. Pat. No. 6,598,856 is designed to remove tent stakes. Like GB2511420, U.S. Pat. No. 6,598,856 does not connect to a post in a secure manner and has no provision for lifting buried posts.

With the above in mind there still exists a need in the art for a system that is designed to pull a buried post or pole from the ground with or without a concrete foundation attached. There is also a need for the system to remove the concrete if the post has rotted or broken off at ground level. Preferably, the system should also be able to remove small trees and bushes, root and all, and remove the chore of having to dig each post out of the ground by hand. In addition, preferably the system should be portable and light weight enough for one person to move it around and use it in the environment they need to work in.

SUMMARY OF THE INVENTION

The present invention is directed to a sub-surface pole remover. The pole remover includes a portable frame that can be moved by a standalone individual. On the frame there is mounted a pump configured to pressurize a fluid. In addition, a fluid cylinder is also mounted on said frame. The cylinder is configured to receive the pressurized fluid from the pump. A piston is slidably mounted in the cylinder. Preferably the fluid is air or hydraulic fluid but an electrical lift mechanism may be used in place of the fluid cylinder.

The pole remover may have different arrangements for grabbing a fence post. In one preferable arrangement a steel rope or the like is attached to the lifting piston of the cylinder, at one end of the rope, and wrapped around a post at the other end of the rope. In another preferred arrangement, a sub-surface grapnel is connected to said lifting piston. The grapnel has a plurality of lower arms that extend from a central circular support and are configured to grip a sub-surface pole. A cable connects the grapnel to the piston. The grapnel has a top circular support and the central circular support is connected to the top circular support by a plurality of flexible cables (e.g., steel rope pieces). The middle circular support is connected to a plurality of upper arms and a bottom circular support is connected to a plurality of lower arms in a pivotable manner, and the upper arms are pivotably connected to the lower arms. Each lower arm includes gripping teeth configured to engage a pole or foundation and is also configured to be hammered into the ground.

A control lever (e.g., a switch) is configured to direct the pressurized fluid from the pump to the cylinder whereby the cylinder is actuated to cause the piston to extend and push an attachment member upward relative to the portable frame and remove the sub-surface pole from the ground. Alternatively, the control lever may control an electric motor or lift mechanism.

A method of using the pole remover includes gripping a sub-surface pole located below ground with the plurality of lower arms of the sub-surface grapnel. As noted above, the grapnel is connected to the lifting piston by the attachment member. The method further includes directing fluid from the pump to the cylinder to cause the lifting piston to extend and push the attachment member upward relative to the portable frame and thereby remove the sub-surface pole from the ground. Preferably an individual using the grapnel starts by hammering the lower arms of the grapnel into the ground to engage the foundation with the gripping teeth of the lower arms.

Additional objects, features and advantages of the present invention will become more readily apparent from the following detailed description of preferred embodiments when taken in conjunction with the drawings wherein like reference numerals refer to corresponding parts in the several views.

BRIEF DESCRIPTION OF THE DRAWINGS

The disclosure may be more completely understood in consideration of the following description of various illustrative embodiments in connection with the accompanying drawings.

DETAILED DESCRIPTION OF PREFERRED EMBODIMENTS

Figure 1:
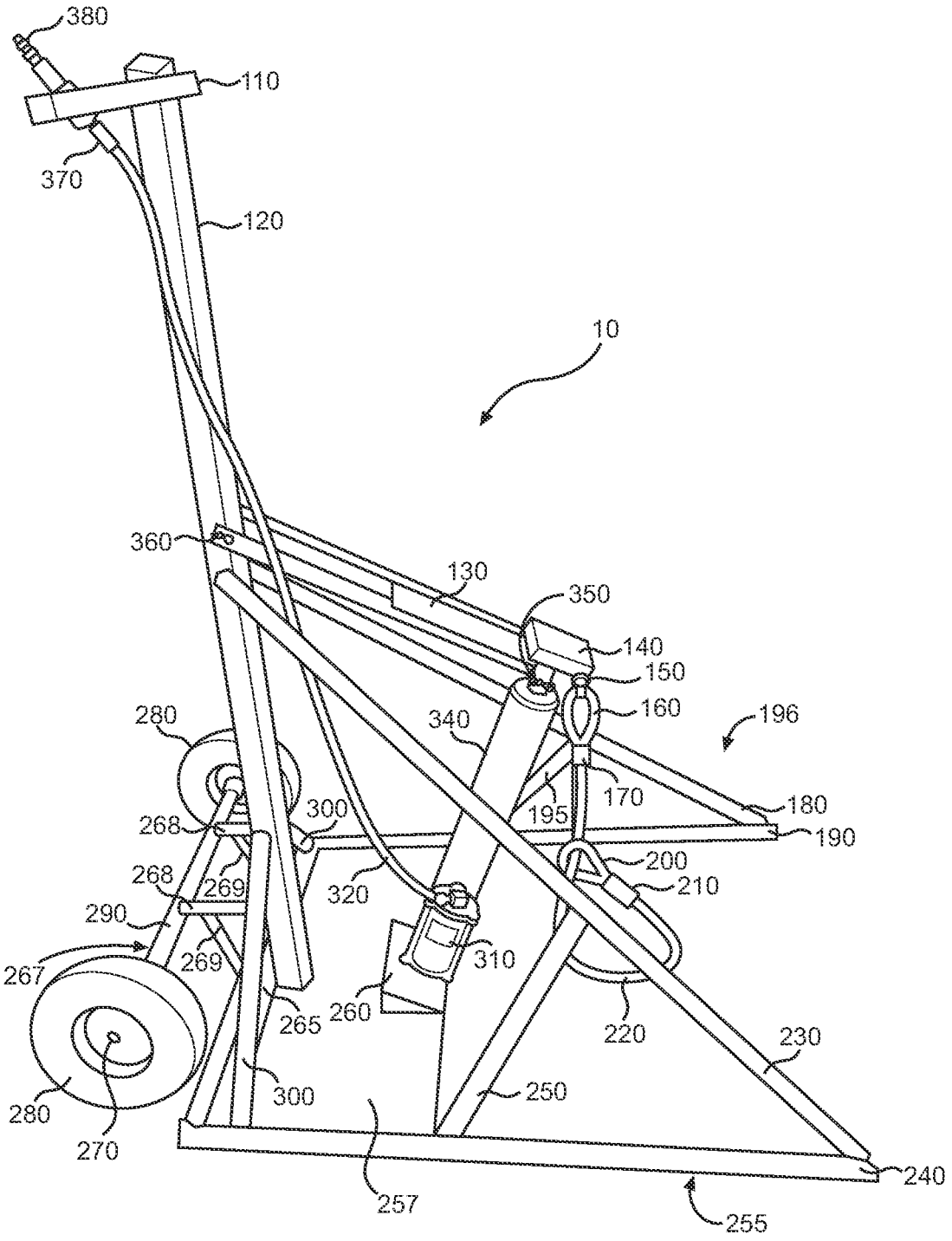
FIG. 1 is a perspective view of a sub-surface pole remover with a steel rope post gripper in accordance with a first preferred embodiment of the invention.

The following detailed description should be read with reference to the drawings in which similar elements in different drawings are numbered the same. The detailed description and the drawings, which are not necessarily to scale, depict illustrative embodiments and are not intended to limit the scope of the disclosure. Instead, the illustrative embodiments depicted are intended only as exemplary. Selected features of any illustrative embodiment may be incorporated into an additional embodiment unless clearly stated to the contrary. While the disclosure is amenable to various modifications and alternative forms, specifics thereof have been shown by way of example in the drawings and will be described in detail. It should be understood, however, that the intention is not to limit aspects of the disclosure to the particular illustrative embodiments described. On the contrary, the intention is to cover all modifications, equivalents, and alternatives falling within the spirit and scope of the disclosure.

As used throughout this application, the singular forms "a", "an" and "the" include plural forms unless the content clearly dictates otherwise. In addition, the term "or" is generally employed in its sense including "and/or" unless the content clearly dictates otherwise.

Figure 2:
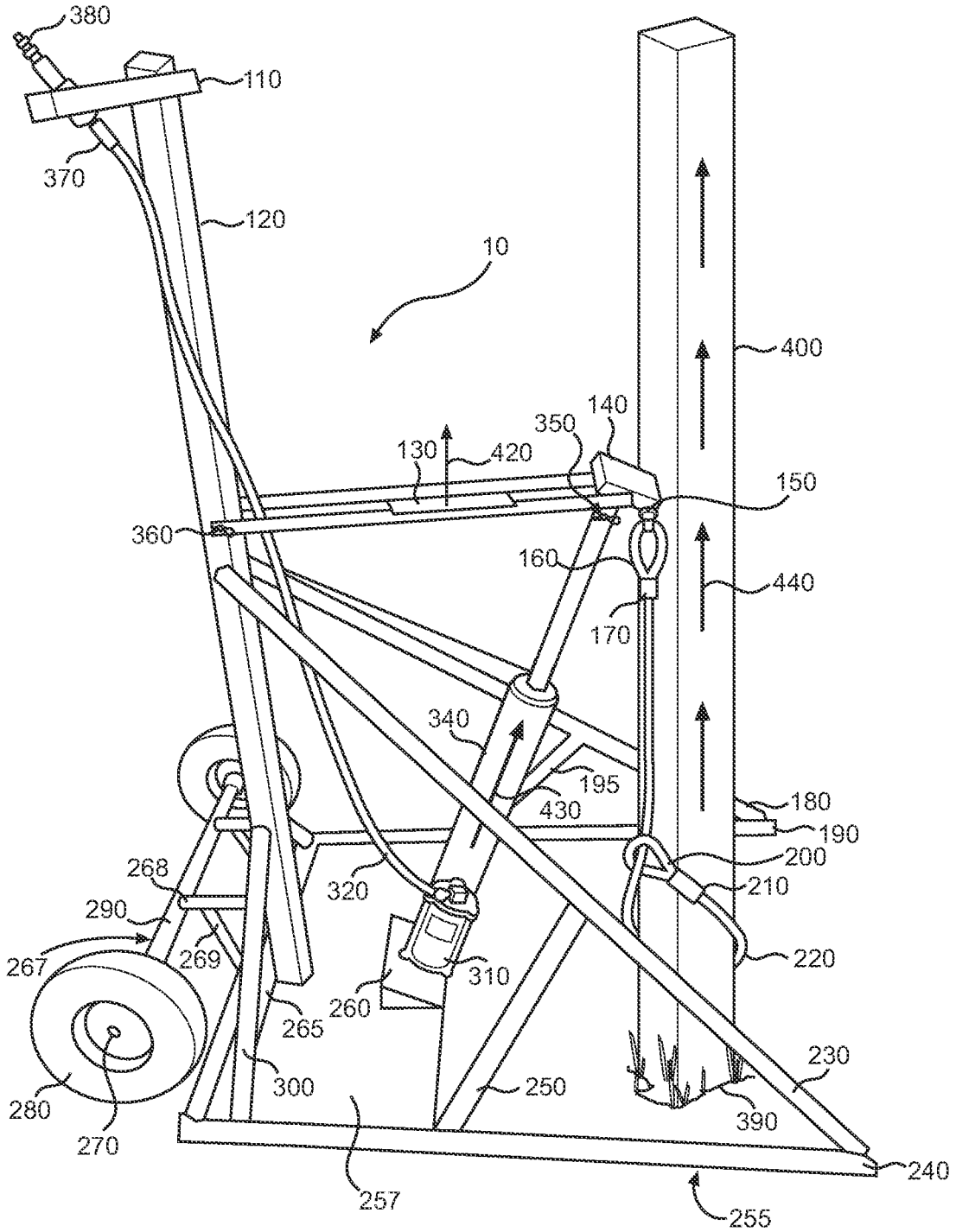
FIG. 2 is a perspective view of the sub-surface pole remover of FIG. 1 pulling a fence post out of the ground.
Figure 3:
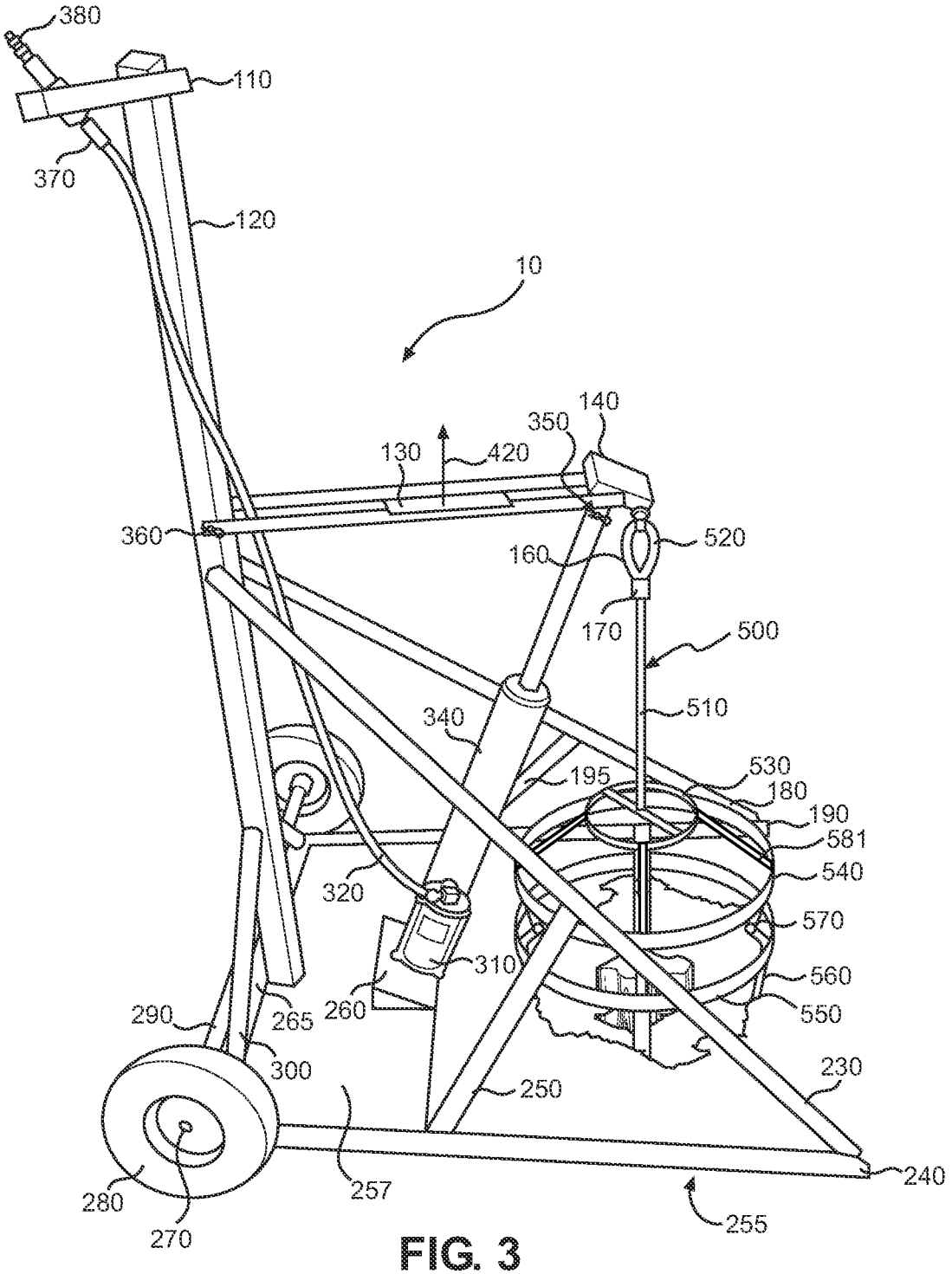
FIG. 3 is a perspective view of a sub-surface pole remover employing a grapnel in place of the steel rope post gripper of FIG. 1 in accordance with a second preferred embodiment of the invention pulling a fence post out of the ground.

Referring to FIGS. 1 and 2, there is shown a perspective view of a first preferred embodiment of a sub-surface pole remover 10 that may be operated by a single user. Pole remover 10 has a handle bar 110 that is gripped by the user to move pole remover 10 from place to place. Preferably, handle bar 110 extends horizontally from a main bar 120. Handle bar 110 is preferably provided with two grips, one for each hand of the user. The grips are not separately labeled. Handle bar 110 is preferably made of round steel pipe or a similar type of strong material but may be portable and light weight enough for one person to move it around and use it in the environment they need to work in.

Main bar 120 extends downwardly from handle bar 110. Main bar 120 is also preferably made of steel and is connected to a work lever 130. Work lever 130 is mounted so as to be able to pivot relative to main bar 120. Work lever 130 is also connected to an attachment member 140. A hook or pin 150, connected to attachment member 140 provides a mounting for a first steel rope loop 160. The first steel rope loop 160 is maintained in its shape by a first swage coupling 170.

Main bar 120 is also connected to a pair of main struts. A first main strut 180 extends downward at an angle to a first horizontally extending foot 190 to help support main bar 120. A first support strut 195 extends between first main strut 180 and first foot 190 and forms a first support assembly 196. Thus, main bar 120 is able to support work lever 130. A second steel rope loop 200 is held in place by a second swage coupling 210 so that a steel rope 220 (which connects swages 170 and 210) may be placed about an object (e.g., a sub-surface pole) above or below ground and apply a force to the object via work lever 130. A second main strut 230 also extends between main bar 120 and a second horizontally extending foot 240 coupled with a second support strut 250 to form a second support assembly 255 with a triangular opening. Main struts 180, 230, support struts 195, 250 and feet 190, 240 are preferably all made of a strong material, such as 1 inch by 1 inch G carbon steel. Preferably support assemblies 196, 255 extend symmetrically from the sides of main bar 120 such that pole remover 10 stands upright in a stable configuration with both feet 190, 240 on the ground. A solid plate 257 extends between feet 190, 240 and is also connected to main bar 120, preferably by welding. Solid plate 257 provides a mount 260 with a pin to secure a lifting mechanism (described further below). A back wall 265 extends vertically along main bar 120.

A wheel assembly 267 is preferably mounted to the rear portion of solid plate 257. Wheel assembly 267 includes two support legs, each leg including a horizontal support arm 268 and an angled support arm 269. An axle 270 supports two wheels 280. Each horizontal support arm 268 is connected to a horizontal axle holder 290 at one end and to a main bar support strut 300 at its other end. Each angled support arm 269 extends between plate 257 and its respective horizontal support arm 268 and provides additional reinforcement for horizontal axle holder 290. Horizontal axle holder 290 preferably supports wheels 280. Each wheel 280 has a rim that supports an approximately sixteen-inch non-inflatable polypropylene foam tire with a ¾ inch axel. Each wheel 280 is preferably rotatably supported on axle 270 mounted within horizontal axle support 290.

The lifting mechanism, mentioned above, includes a motor 310 that is preferably driven by compressed air, hydraulic fluid or electricity. A compressed air hose 320 extends from motor 310, up along main bar 120 and to handle bar 110. Alternatively, hose 320 could contain hydraulic fluid. A control lever in the form of a switch 370 is located in compressed air hose 320 near handle bar 110. A connector 380 is provided for allowing compressed air or hydraulic fluid to be introduced from a compressor to hose 320. Switch 370 may be actuated to allow compressed air or hydraulic fluid to travel to motor 310 or to prevent compressed air or hydraulic fluid from traveling to motor 310. Preferably, a long ram jack 340 with an 8-ton rating is secured on mount 260. Jack 340 is secured to the mount with a base lock including a pin configured to secure jack 340 to mount 260. Jack 340 is connected at its upper end to attachment member 140 attached to work lever 130 by pin 350. Work lever 130 is attached by a ½ inch carbon steel pin 360 to main bar 120 so that as jack 340 extends, work lever 130 pivots about pin 360.

Pole remover 10 has a relatively simple operation. A user grabs handle bar 110 and pulls back on main bar 120 to pivot and lift feet 190, 240 off of ground 390 (labeled in FIG. 2) such that the weight of pole remover 10 is supported by wheels 280. The user then moves pole remover 10 to a fence post 400 and steel rope 220 is looped around post 400, as shown in FIG. 2. The user then actuates switch 370 to supply compressed air or hydraulic fluid to motor 310. Motor 310 sends air or hydraulic fluid into jack 340, causing jack 340 to extend toward work lever 130 as shown by an extending force arrow 430. Work lever 130 pivots upward in respond to the extension of jack 340 as shown by a vertical force arrow 420. Pole remover 10 remains stable due to feet 190, 240 which are supported by ground 390. As jack 340 extends, steel rope 220 tightens or cinches around fence post 400 and forces fence post 400 upward and out of ground 390 as shown by a vertical motion arrow 440.

In a second preferred embodiment, as shown in FIGS. 3-6, pole remover 10 from the first embodiment, shown in FIGS. 1 and 2, has been modified in two respects. First, axle support 290 is shown as mounted directly to plate 257. It should be noted that wheel assembly 267 from the first preferred embodiment could be used in the second preferred embodiment and the wheel arrangement of the second embodiment could be used in the first embodiment.

The second change is that steel rope 220 in the first embodiment has been replaced with a sub-surface grapnel 500. The top of grapnel 500 is attached to work lever 130 by a connector 510 to a top circular support 530. Connector 510 is connected to first steel rope loop 160 that is maintained in its oval shape 520 by a first swage coupling 170. Grapnel 500 also includes a middle circular support 540 and a bottom circular support 550. Bottom circular support 550 is in the shape of a circle and supports free moving lower arms 560. Four lower arms 560 are shown in the drawings but three to six lower arms 560 are all considered preferable and six lower arms 560 is considered most preferable.

Figure 4:
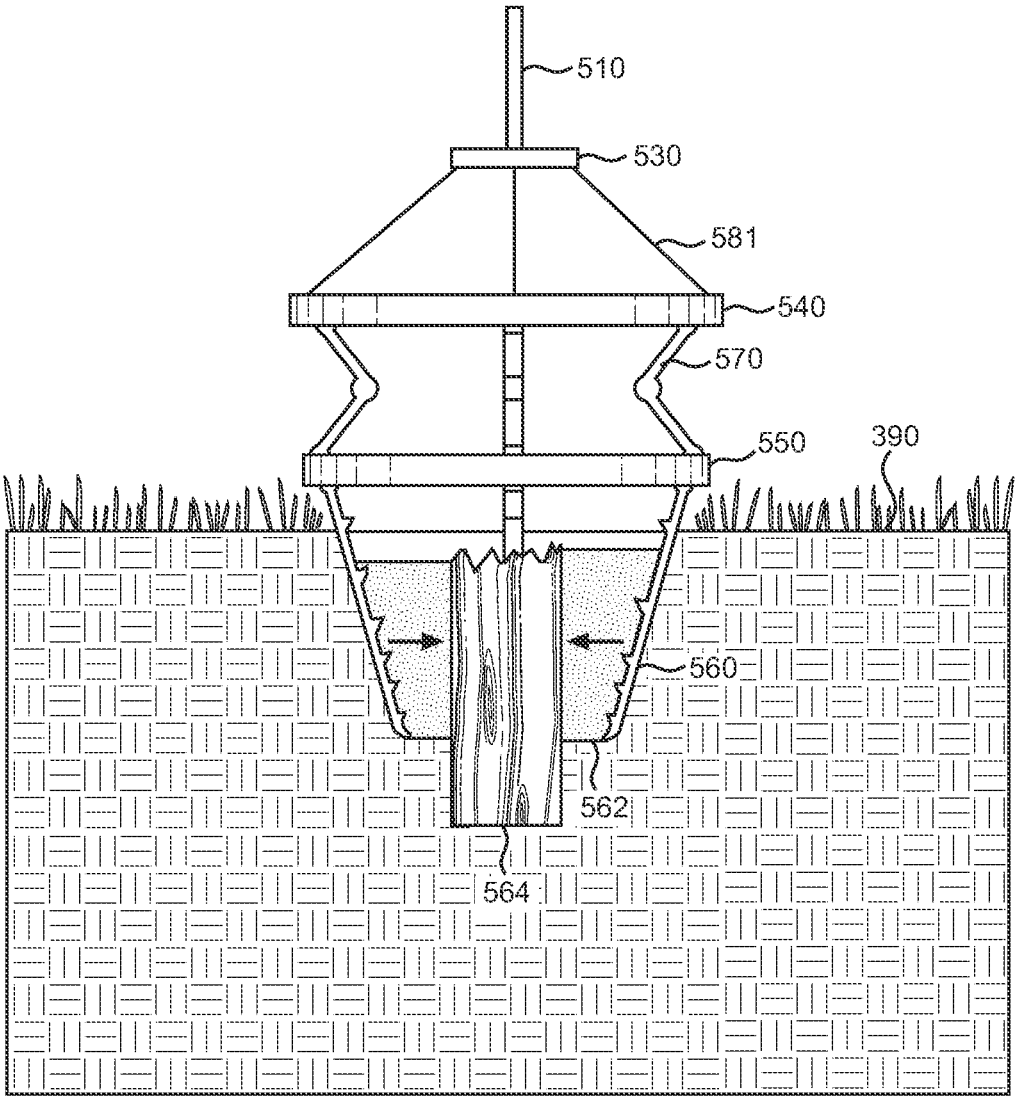
FIG. 4 is a side view of the grapnel of FIG. 3.
Figure 6:
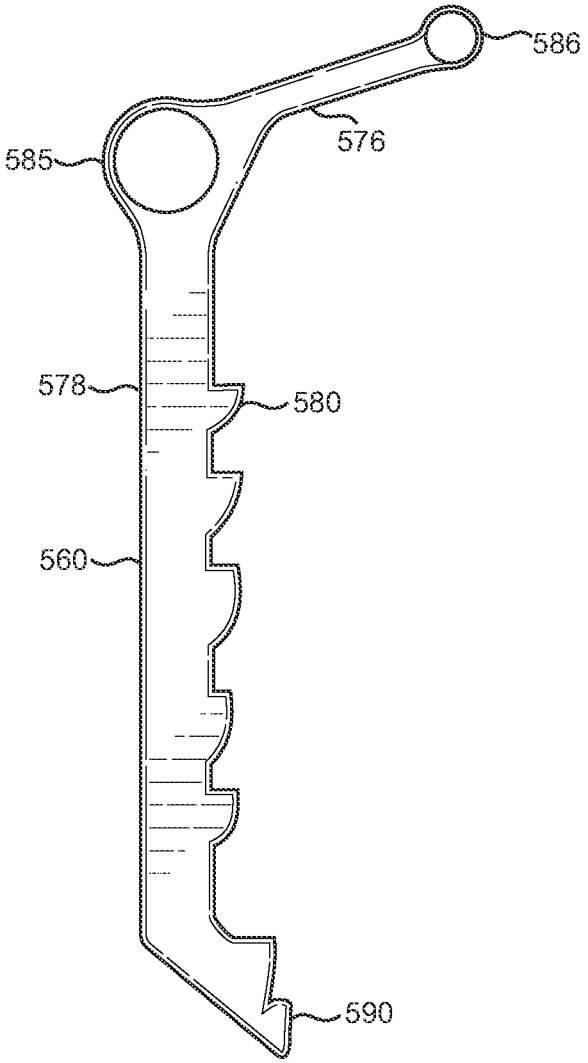
FIG. 6 is a close up view of a grapnel lower arm with gripping teeth from the grapnel of FIG. 3.

Lower arms 560 are spaced evenly around bottom circular support 550. As best shown in FIG. 6, lower arms 560 each include a central circular shaped opening 585 to fit around bottom circular support 550. Lower arms 560 are mounted for pivotal motion so as to be engaged with a foundation 562 of a fence post 564, as shown in FIG. 4. As shown in FIG. 6, each lower arm 560 has a top lever arm 576 that extends from central circular opening 585 and terminates in a ring shape formed with a top circular opening 586 and a lower lever arm 578 that has a set of gripping teeth 580 extending to a tip 590.

Figure 5:
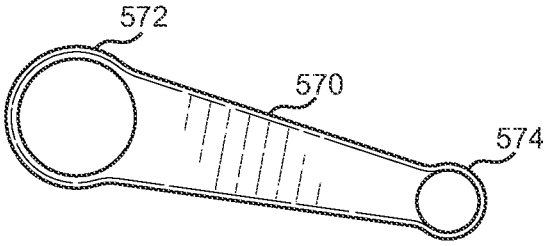
FIG. 5 is a close up view of a grapnel upper arm from the grapnel of FIG. 3.

A set of upper arms 570 is provided with each upper arm having a top circular opening 572 and a lower circular opening 574, as best seen in FIG. 5. Middle circular support 540 pivotably supports top circular opening 572 of each upper arm 570 in a pivotable manner. Lower circular opening 574 of each upper arm 570 is connected to top circular 586 opening of a respective lower arm 560 to form a pivoting joint.

Top circular support 530 is connected to middle circular support 540 with a series of steel rope pieces 581 (flexible cables). Preferably, there are three to six steel rope pieces 581 and, most preferably, four steel rope pieces 581 are employed. The other parts of fence post puller 10 are preferably all made of 1½ inch schedule 40 carbon steel. The size of bottom circular support 550, middle circular support 540 and top circular support 530 may vary. Preferably top circular support 530 has a 7-inch diameter, middle circular support 540 has a 20-inch diameter, and bottom circular support has an 18-inch diameter, but the relative sizes can be varied.

Fence post remover 10 is designed to provide easy extraction of fence post 400 or fence post 564 and concrete foundation 562 surrounding post 564 that is situated below ground 390 as described below. Initially, fence post remover 10 is partially disassembled. Bottom circular support 550 and its associated free moving lower arms 560 are placed above ground 390 around fence post 564 that is considered a target fence post. Lower arms 560 are positioned around target fence post 564. Lower arms 560 are then adjusted based on the size and shape of target fence post 564 and its associated foundation 562. Lower arms 560 are then hammered into ground 390 around target fence post 564. Middle circular support 540 and its associated set of upper arms 570 are then positioned over bottom circular support 550. Lower circular opening 574 of each upper arm 570 is connected to top circular opening 586 of a respective lower arm 560 to form a series of pivoting joints. Top circular support 530 is then connected to middle circular support 540 with a series of steel rope pieces 581. Top circular support 530 is also connected to attachment member 140. These steps can be combined such that portions of pole remover 10 are pre-assembled before pole remover 10 is placed near fence post 564. Lower arms 560 are then hammered into ground 390 around target fence post 564 and in either case the operation then proceeds in the same manner as described below.

By actuating switch 370, air or hydraulic fluid is sent through compressed air hose 320 to motor 310. Motor 310 provides compressed air or hydraulic fluid to ram jack 340 to raise work lever 130 and attachment member 140. The jack 340 could also use an electrical system to provide the upward force. As an upward force is applied to top circular support 530 an upward force is applied to steel rope pieces 581, this force also applies an upward force on middle circular support 540. Lower lever arms 578 of lower arms 560 move inwardly toward each other when top lever arms 576 of lower arms 560 are pulled upwardly and outwardly. Each lower arm 560 pivots about bottom circular support 550 with bottom circular support 550 acting as a fulcrum to apply a lateral force on fence post 564 while also pulling fence post 564 upward. In a preferred embodiment, pressures up to 18,500 lbs. of force have been applied on fence post puller 10 in operation. Preferred embodiments of the invention may also be used for transport of other tools and articles on job site.

Based on the above, it should be readily apparent that the present invention provides for an easy way for a user to remove a fence post. Even fence posts that are secured in place with a concrete foundation and have a portion of the fence post broken, can be easily removed. Although described with reference to preferred embodiments of the invention, it should be readily understood that various changes and/or modifications can be made to the invention without departing from the spirit thereof. For example, any of the features of one embodiment could be incorporated into any other embodiment.

We claim:

1. A sub-surface pole and pole foundation remover comprising:

a portable frame;

a cylinder mounted on said frame and configured to receive pressurized fluid;

a lifting piston slidably mounted in the cylinder;

a subsurface grapnel connected to said lifting piston and comprising a plurality of lower arms that extend from a bottom circular support and that are configured to grip a sub-surface pole located below ground, wherein the grapnel has a top circular support and a middle circular support connected to the top circular support by a plurality of flexible cables; and a control lever configured to direct the pressurized fluid to the cylinder whereby the cylinder is actuated to cause the lifting piston to extend and push the grapnel upward relative to the portable frame and remove the sub-surface pole from the ground.

2. The sub-surface pole and pole foundation remover of claim 1, further comprising an attachment member including a cable connecting the grapnel to the piston.

3. The sub-surface pole and pole foundation remover of claim 1, wherein the grapnel has a top circular support and a middle circular support connected to the top circular support by a plurality of flexible cables.

4. The sub-surface pole and pole foundation remover of claim 3, wherein the middle circular support is connected to a plurality of upper arms and the bottom circular support is connected to the plurality of lower arms in a pivotable manner, and the upper arms are connected to the lower arms.

5. The sub-surface pole and pole foundation remover of claim 4, wherein each lower arm includes gripping teeth configured to engage the pole or foundation and is also configured to be hammered into the ground.

6. The sub-surface pole and pole foundation remover of claim 1, wherein the pressurized fluid is hydraulic.

7. A method of removing sub-surface poles and pole foundations comprising:

gripping a sub-surface pole located below ground with a plurality of lower arms of a sub-surface grapnel comprising a plurality of lower arms that extend from a bottom circular support and are configured to grip the sub-surface pole located below ground wherein the grapnel has a top circular support and a middle circular support connected to the top circular support by a plurality of flexible cables, said sub surface grapnel connected to a lifting piston; and directing fluid to a cylinder to cause a lifting piston to extend and push the piston, connected to the grapnel, upward relative to a portable frame and thereby remove the sub-surface pole from the ground.

8. The method according to claim 7, further comprising hammering the lower arms of the grapnel into the ground to engage teeth on the lower arms with the foundation.

9. The method according to claim 7, further comprising directing hydraulic fluid to cylinder.

10. A sub-surface pole and pole foundation remover comprising:

a portable frame;

a cylinder mounted on said frame and configured to receive pressurized fluid;

a lifting piston slidably mounted in the cylinder;

a flexible cinching loop connected to said lifting piston configured to grip a sub-surface pole below ground;

a control lever configured to direct the pressurized fluid to the cylinder whereby the cylinder is actuated to cause the lifting piston to extend and pull the flexible cinching loop upward relative to the portable frame and remove the sub-surface pole from the ground; and a grapnel connected to said lifting piston and having a plurality of lower arms that extend from a bottom circular support and that are configured to grip a sub-surface pole located below ground wherein the grapnel has a top circular support and a middle circular support connected to the top circular support by a plurality of flexible cables.

11. The sub-surface pole and pole foundation remover of claim 10, wherein the middle circular support is connected to a plurality of upper arms and the bottom circular support is connected to the plurality of lower arms in a pivotable manner, and the upper arms are connected to the lower arms.

12. The sub-surface pole and pole foundation remover of claim 10, wherein the pressurized fluid is hydraulic.

* * * * *